US009177542B2

(12) United States Patent
Pan

(10) Patent No.: US 9,177,542 B2
(45) Date of Patent: Nov. 3, 2015

(54) MOTOR VEHICLE ADAPTIVE FEED-FORWARD NOISE REDUCTION

(71) Applicant: Bose Corporation, Framingham, MA (US)

(72) Inventor: Davis Y. Pan, Arlington, MA (US)

(73) Assignee: Bose Corporation, Framingham, MA (US)

( * ) Notice: Subject to any disclaimer, the term of this patent is extended or adjusted under 35 U.S.C. 154(b) by 284 days.

(21) Appl. No.: 13/853,265

(22) Filed: Mar. 29, 2013

(65) Prior Publication Data

US 2014/0294189 A1 Oct. 2, 2014

(51) Int. Cl.
*G10K 11/16* (2006.01)
*G10K 11/178* (2006.01)

(52) U.S. Cl.
CPC ..... *G10K 11/16* (2013.01); *G10K 11/1784* (2013.01); *G10K 2210/128* (2013.01); *G10K 2210/3027* (2013.01); *G10K 2210/3028* (2013.01); *G10K 2210/511* (2013.01)

(58) Field of Classification Search
CPC ..... G10K 2210/1282
USPC ..... 381/71.4
See application file for complete search history.

(56) References Cited

U.S. PATENT DOCUMENTS

2009/0060217 A1 3/2009 Sakamoto et al.
2009/0067638 A1 3/2009 Sakamoto et al.
2010/0061564 A1 3/2010 Clemow et al.
2010/0098263 A1* 4/2010 Pan et al. ..... 381/71.11
2010/0098265 A1* 4/2010 Pan ..... G10K 11/178 381/94.1
2010/0239105 A1* 9/2010 Pan ..... 381/94.9
2014/0286499 A1* 9/2014 Ganeshkumar et al. ..... 381/71.1

FOREIGN PATENT DOCUMENTS

CN 101976560 A 2/2011
EP 1515304 A2 3/2005
EP 1772852 A1 4/2007

OTHER PUBLICATIONS

Konno, Fumiyasu et al., Active Noise Control System for Engine Booming Noise, Panasonic Technical Journal, Jan. 2009, vol. 54 No. 4.

International Search Report mailed Mar. 7, 2014 for corresponding PCT Application No. PCT/US2014/019323.

(Continued)

*Primary Examiner* — Simon King
(74) *Attorney, Agent, or Firm* — Brian M. Dingman; Dingman, McInnes & McLane, LLP

(57) ABSTRACT

A system, device and method that is configured to operate an active noise reduction system for a motor vehicle, where there is an adaptive feed-forward noise reduction system input sine wave at a frequency to be cancelled, and where the adaptive feed-forward noise reduction system includes an adaptive filter that outputs noise reduction signals that are used to drive one or more transducers with their outputs directed to reduce engine noise, and further includes an input transducer with an output signal that is a source of a control signal for the adaptive filter. The output signal of the input transducer is filtered before it reaches the adaptive filter so as to reduce the level of the output signal of the input transducer at one or more frequencies that are close to the frequency of the input sine wave.

19 Claims, 2 Drawing Sheets

(56) References Cited

OTHER PUBLICATIONS

Written Opinion of the International Searching Authority mailed Mar. 7, 2014 for corresponding PCT Application No. PCT/US2014/019323.

Hakansson, L., The Filtered-x LMS Algorithm, Department of Telecommunications and Signal Processing, Jan. 15, 2004, University of Karlskrona/Ronneby 372 25 Ronneby, Sweden downloaded from the Internet on Jul. 23, 2015.

* cited by examiner

MOTOR VEHICLE ADAPTIVE FEED-FORWARD NOISE REDUCTION

FIELD

This disclosure relates to the active reduction of engine noise in a motor vehicle.

BACKGROUND

Engine harmonic cancellation systems are adaptive feed-forward noise reduction systems that are used in motor vehicles, for example in cabins or in muffler assemblies, to reduce or cancel engine harmonic noise. Engine harmonic cancellation systems often use one or more microphones as input transducers. A sine wave at the frequency to be cancelled is also used as an input to an adaptive filter. The adaptive filter can alter the magnitude and/or the phase of the input sine wave. The output of the adaptive filter is applied to one or more transducers that produce sound (i.e., loudspeakers) that is acoustically opposite to the undesirable engine harmonics that are to be canceled. The aim of the system is to cancel the microphone signal at the frequency or frequencies of interest. In order to do so, the loudspeaker outputs have a negative gain.

Because the transfer function of the volume in which noise is being cancelled can change over time, such engine harmonic cancellation systems can significantly amplify noise at frequencies that are close to the frequency of the input sine wave. Schemes that are aimed to mitigate this noise amplification problem result in reduction of the cancellation performance of the system.

SUMMARY

The system, device and method of this disclosure are effective to reduce or eliminate the amplification of noise at frequencies that are close to the frequency of the sine wave that is input to the adaptive filter of an engine harmonic cancellation system. This is accomplished by filtering these frequencies from the error microphone output before it is used as a control input to the adaptive filter. The frequencies can be reduced or essentially eliminated.

All examples and features mentioned below can be combined in any technically possible way.

In one aspect, a method for operating an adaptive feed-forward noise reduction system for a motor vehicle, where there is an adaptive feed-forward noise reduction system input sine wave at a frequency to be cancelled, and where the adaptive feed-forward noise reduction system comprises an adaptive filter that outputs noise reduction signals that are used to drive one or more transducers with their outputs directed to reduce engine noise, and further comprises an input transducer with an output signal that is a source of a control signal for the adaptive filter, includes filtering the output signal of the input transducer before it reaches the adaptive filter so as to reduce the level of the output signal of the input transducer at one or more frequencies that are close to the frequency of the input sine wave to be cancelled.

Embodiments may include one of the following features, or any combination thereof. The filtering of the output signal of the input transducer can be accomplished using an adaptive narrowband filter with a narrowband filter output signal. The sine wave may also be provided to a modeled cabin transfer function to produce a revised reference signal. The sine wave, or parameters from which the sine wave can be reconstructed, may also be provided as an input to the adaptive narrowband filter. The revised reference signal may be multiplied with the adaptive narrowband filter output signal, and then provided as an input to the adaptive filter, to direct the adaptation of the adaptive filter. The adaptive narrowband filter output signal may be subtracted from the output signal of the input transducer to create a combined signal. The combined signal may be multiplied with the sine wave and provided as an input to the adaptive narrowband filter, to direct the adaptation of the adaptive narrowband filter. An input sine wave frequency may comprise an engine harmonic noise frequency. The transducer outputs may be directed into the vehicle cabin or into a volume of the motor vehicle other than the cabin.

In another aspect, an adaptive feed-forward noise reduction system for a motor vehicle, where there are one or more transducers with their outputs directed to reduce engine noise and where there is an input sine wave at a frequency to be cancelled, includes an adaptive filter that outputs noise reduction signals that are used to drive the transducers, an input transducer with an output signal that is a source of a control signal for the adaptive filter, and an adaptive narrowband filter that filters the output signal of the input transducer before it reaches the adaptive filter so as to reduce the level of the output signal of the input transducer at one or more frequencies that are close to the frequency of the input sine wave.

Embodiments may include one of the following features, or any combination thereof. The system may further comprise a modeled cabin transfer function, wherein the sine wave is also provided to the modeled cabin transfer function to produce a revised reference signal. The sine wave, or parameters from which the sine wave can be reconstructed, may also be provided as an input to the adaptive narrowband filter. The adaptive narrowband filter may have a narrowband filter output signal, and the revised reference signal may be multiplied with the adaptive narrowband filter output signal and then provided as an input to the adaptive filter, to direct the adaptation of the adaptive filter. The adaptive narrowband filter output signal may be subtracted from the output signal of the input transducer to create a combined signal. The combined signal may be multiplied with the sine wave and provided as an input to the adaptive narrowband filter, to direct the adaptation of the adaptive narrowband filter. An input sine wave frequency may comprise an engine harmonic noise frequency. The transducer outputs may be directed into the vehicle cabin or into a volume of the motor vehicle other than the cabin.

DETAILED DESCRIPTION

Figure 1:
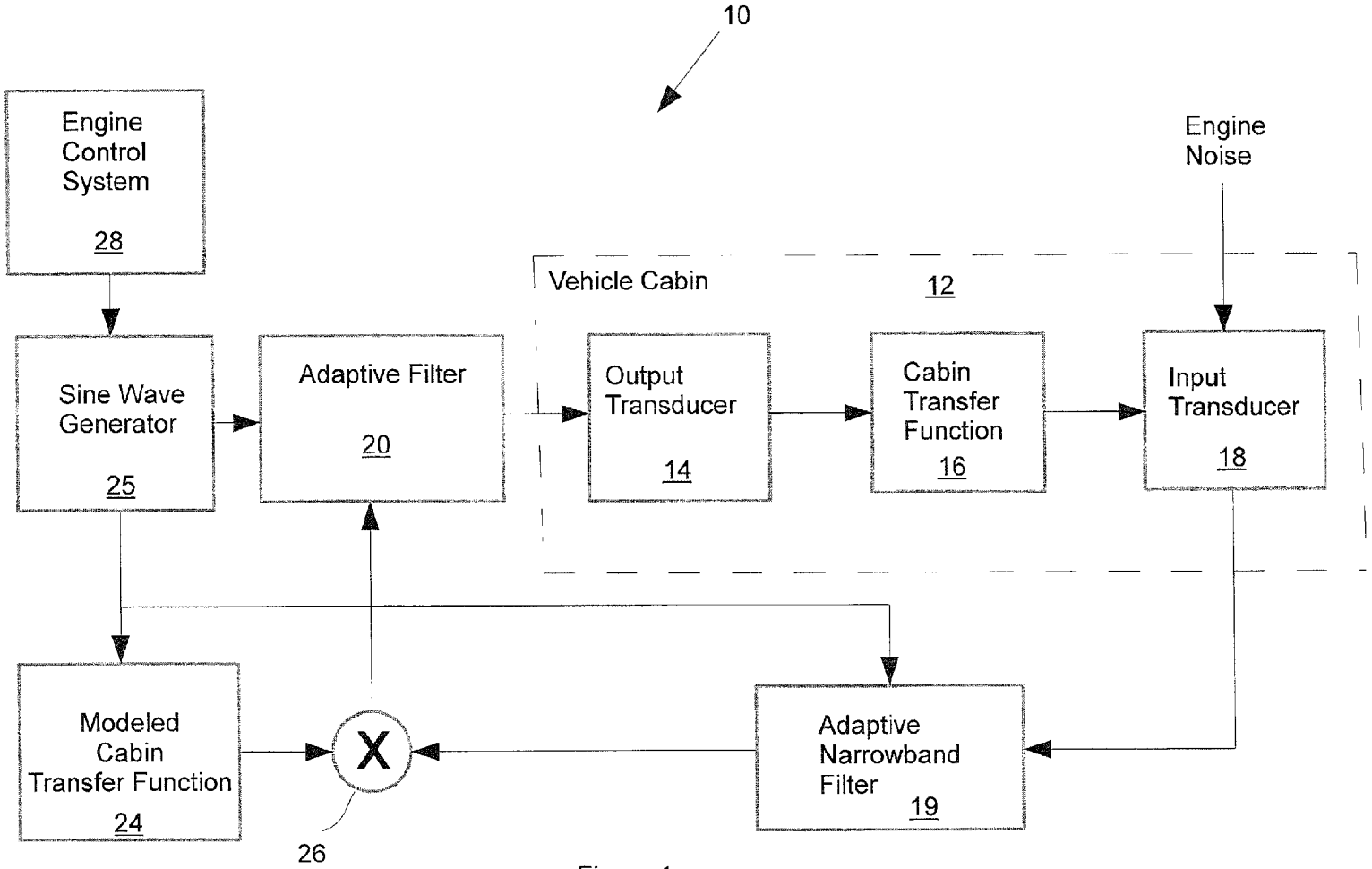
FIG. 1 is a schematic block diagram of an engine harmonic cancellation system that can be used to accomplish the system, device and method of the present innovation.
Figure 2:
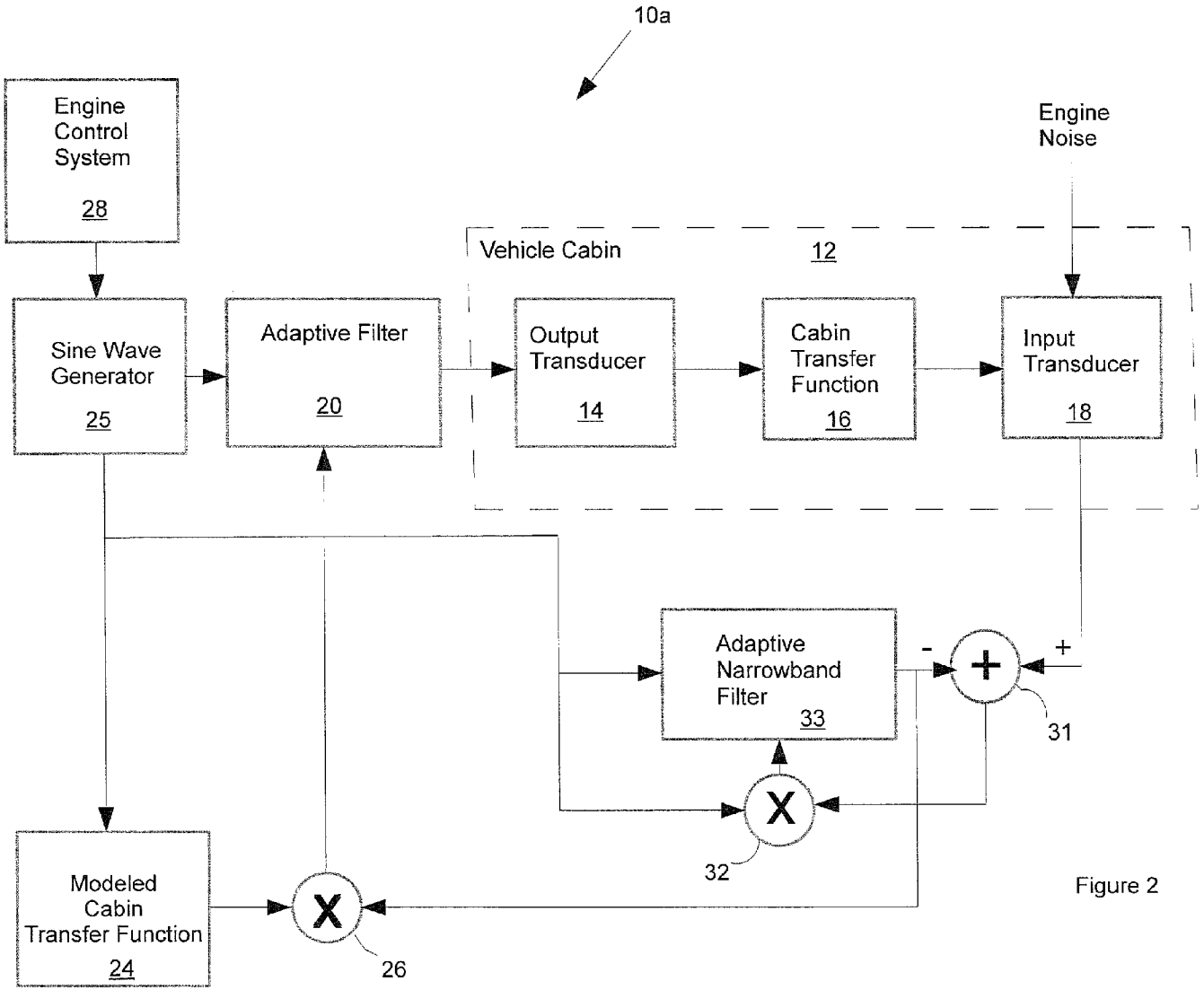
FIG. 2 is a schematic block diagram of another engine harmonic cancellation system that can be used to accomplish the system, device and method of the present innovation.

Elements of FIGS. 1 and 2 of the drawings are shown and described as discrete elements in a block diagram. These may be implemented as one or more of analog circuitry or digital circuitry. Alternatively, or additionally, they may be implemented with one or more microprocessors executing software instructions. The software instructions can include digital signal processing instructions. Operations may be performed by analog circuitry or by a microprocessor executing software that performs the equivalent of the analog operation. Signal lines may be implemented as discrete analog or digital signal lines, as a discrete digital signal line with appropriate signal processing that is able to process separate signals, and/or as elements of a wireless communication system.

When processes are represented or implied in the block diagram, the steps may be performed by one element or a plurality of elements. The steps may be performed together or at different times. The elements that perform the activities may be physically the same or proximate one another, or may be physically separate. One element may perform the actions of more than one block. Audio signals may be encoded or not, and may be transmitted in either digital or analog form. Conventional audio signal processing equipment and operations are in some cases omitted from the drawing.

FIG. 1 is a simplified schematic block diagram of an adaptive feed-forward engine harmonic cancellation system 10 that illustrates one example of the disclosed innovation. In this non-limiting example system 10 is designed to cancel engine harmonic noise in the cabin of a motor vehicle. However, system 10 can be used to reduce harmonic noise emanating from sources other than the engine, e.g., the drive shaft or other rotating or oscillating devices or volumes such as motors or the tire cavities. System 10 can also be used to reduce harmonic noise in locations other than motor vehicles and in volumes other than motor vehicle cabins. As one non-limiting example, system 10 could be used to cancel engine harmonics in the vehicle's muffler assembly.

System 10 uses adaptive filter 20 that supplies signals to one or more output transducers 14 that have their outputs directed into vehicle cabin 12. The output of the transducers, as modified by the cabin transfer function 16, is picked up by an input transducer (e.g., microphone) 18. Engine noise in the vehicle cabin is also picked up by input transducer 18. Existing vehicle engine control system 28 supplies one or more input signals that are related to the vehicle engine operation. Examples include RPM, torque, accelerator pedal position, and manifold absolute pressure (MAP). A sine wave generator 25 is input with the signal(s) from engine control system 28 that relate to vehicle engine operation, and from which frequencies of the engine harmonic to be canceled can be determined. When the system is used to cancel harmonic noise from oscillating or rotating devices other than the engine, sine wave generator 25 is input with a harmonic frequency to be cancelled that is derived from or computed based on operation of the oscillating or rotating device.

Sine wave generator 25 provides to adaptive filter 20 a noise reduction reference signal that is also provided to modeled cabin transfer function 24 to produce a revised reference signal. The revised reference signal and the microphone output signal (after it is filtered by adaptive narrowband filter 19, described below) are multiplied together 26, and provided as an input to adaptive filter 20 to direct its adaptation. In this non-limiting example the adaptive algorithm is a filtered-x adaptive algorithm. However, this is not a limitation of the innovation as other adaptive algorithms could be used, as would be apparent to those skilled in the technical field. The operation of adaptive feed-forward harmonic noise cancellation systems is well understood by those skilled in the technical field.

Adaptive narrowband filter 19 filters the output of error microphone 18 to reduce or remove frequencies that are adjacent to the frequency of the reference sine wave; the reference sine wave from generator 25 (or parameters from which the sine wave can be reconstructed) are also input to the adaptive narrowband filter. By filtering the error microphone signal so as to reduce or eliminate energy levels at adjacent frequencies, the undesirable amplification of the adjacent noise frequencies is reduced or eliminated. In the context of this disclosure, "adjacent" refers to nearby frequencies that, if there is noise, could cause the adaptive filter to react in a negative way by amplifying that noise. The range of such frequencies depends on the tuning of the adaptive filter 20. The filtering that is accomplished by narrowband filter 19 is sufficient to reduce or potentially effectively eliminate energy levels in these adjacent frequencies. The amount of reduction accomplished depends on the tuning of the adaptive narrowband filter 19. The goal is to accomplish any decrease in the level of noise gain caused by the adaptive filter in the adjacent frequencies.

FIG. 2 is a simplified schematic block diagram of an adaptive feed-forward engine harmonic cancellation system **10*a* that illustrates another example of the disclosed innovation. System 10*a* uses adaptive filter 20 that supplies signals to one or more output transducers 14 that have their outputs directed into vehicle cabin 12. The output of the transducers, as modified by the cabin transfer function 16, is picked up by an input error transducer (e.g., microphone) 18. Engine noise in the vehicle cabin is also picked up by input transducer 18. Existing vehicle engine control system 28 supplies one or more input signals that are related to the vehicle engine operation. Examples include RPM, torque, accelerator pedal position, and manifold absolute pressure (MAP). A sine wave generator 25 is input with the signal(s) from engine control system 28** that relate to vehicle engine operation, and from which frequencies of the engine harmonic to be canceled can be determined.

Sine wave generator 25 provides to adaptive filter 20 a noise reduction reference signal that is also provided to modeled cabin transfer function 24 to produce a revised reference signal. The revised reference signal and the output of the adaptive narrowband filter 33, which is another instantiation of adaptive filter 20 with possibly a different tuning and with outputs not passing through a vehicle cabin 12, are multiplied together 26, and provided as an input to adaptive filter 20 to direct its adaptation. The reference sine wave from generator 25 (or parameters from which the sine wave can be reconstructed) are also input to the adaptive narrowband filter. The output of filter 33 is subtracted from the error microphone output signal by combiner 31. The output of combiner 31 is multiplied with the reference signal from sine wave generator 25, using multiplier 32. The output of multiplier 32 is provided as an input to adaptive narrowband filter 33 to direct the adaptation of that filter. When converged, the output of filter 33 is a sine wave with the same frequency as its input reference sine wave but with the same amplitude and phase as the sinusoidal energy of the signal from the input transducer 18.

The output of adaptive narrowband filter 33 matches the error microphone signal at the frequency of the input sine wave. Signal energies outside of that frequency are significantly reduced or eliminated thus the output is equivalent to the error microphone signal after it passes through a narrowband filter. Filtering the error microphone signal so that only energy at the target cancellation frequency is passed to adaptive feed forward filter 20 reduces or eliminates the undesirable amplification of the adjacent noise frequencies.

The above was described relative to noise cancellation in a vehicle cabin. However, the disclosure applies as well to noise cancellation in other vehicle locations. One additional example is that the system can be designed to cancel noise in a muffler assembly. Such noise may be engine harmonic noise but may also be other engine-operation related noise, as is known in the art.

Embodiments of the devices, systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component. Such computer system and/or software components are therefore enabled by describing their corresponding steps or elements (that is, their functionality), and are within the scope of the disclosure.

The various features of the disclosure could be enabled in different manners than those described herein, and could be combined in manners other than those described herein. A number of implementations have been described. Nevertheless, it will be understood that additional modifications may be made without departing from the scope of the inventive concepts described herein, and, accordingly, other embodiments are within the scope of the following claims.

What is claimed is:

1. A method for operating an adaptive feed-forward noise reduction system for a motor vehicle, where there is an adaptive feed-forward noise reduction system input sine wave at a frequency to be cancelled, and where the adaptive feed-forward noise reduction system comprises an adaptive filter that outputs noise reduction signals that are used to drive one or more transducers with their outputs directed to reduce engine noise, and further comprises an input transducer with an output signal that is a source of a control signal for the adaptive filter, the method comprising filtering the output signal of the input transducer before it reaches the adaptive filter so as to reduce the level of the output signal of the input transducer at one or more frequencies that are adjacent to but not the same as the frequency of the input sine wave.

2. The method of claim 1 wherein filtering of the output signal of the input transducer is accomplished using an adaptive narrowband filter with a narrowband filter output signal.

3. The method of claim 2 wherein the sine wave is also provided to a modeled cabin transfer function to produce a revised reference signal.

4. The method of claim 3 wherein the sine wave, or parameters from which the sine wave can be reconstructed, is also provided as an input to the adaptive narrowband filter.

5. The method of claim 4 wherein the revised reference signal is multiplied with the adaptive narrowband filter output signal, and then provided as an input to the adaptive filter, to direct the adaptation of the adaptive filter.

6. The method of claim 5 wherein the adaptive narrowband filter output signal is subtracted from the output signal of the input transducer to create a combined signal.

7. The method of claim 6 wherein the combined signal is multiplied with the sine wave and provided as an input to the adaptive narrowband filter, to direct the adaptation of the adaptive narrowband filter.

8. The method of claim 1 wherein an input sine wave frequency comprises an engine harmonic noise frequency.

9. The method of claim 1 wherein the transducer outputs are directed into the vehicle cabin.

10. The method of claim 1 wherein the transducer outputs are directed into a volume of the motor vehicle other than the vehicle cabin.

11. An adaptive feed-forward noise reduction system for a motor vehicle, where there are one or more transducers with their outputs directed to reduce engine noise and where there is an input sine wave at a frequency to be cancelled, the system comprising:

an adaptive filter that outputs noise reduction signals that are used to drive the transducers;

an input transducer with an output signal that is a source of a control signal for the adaptive filter; and an adaptive narrowband filter that filters the output signal of the input transducer before it reaches the adaptive filter so as to reduce the level of the output signal of the input transducer at one or more frequencies that are adjacent to but not the same as the frequency of the input sine wave.

12. The system of claim 11 further comprising a modeled cabin transfer function, wherein the sine wave is also provided to the modeled cabin transfer function to produce a revised reference signal.

13. The system of claim 12 wherein the sine wave, or parameters from which the sine wave can be reconstructed, is also provided as an input to the adaptive narrowband filter.

14. The system of claim 13 wherein the adaptive narrowband filter has a narrowband filter output signal, and wherein the revised reference signal is multiplied with the adaptive narrowband filter output signal, and then provided as an input to the adaptive filter, to direct the adaptation of the adaptive filter.

15. The system of claim 14 wherein the adaptive narrowband filter output signal is subtracted from the output signal of the input transducer to create a combined signal.

16. The system of claim 15 wherein the combined signal is multiplied with the sine wave and provided as an input to the adaptive narrowband filter, to direct the adaptation of the adaptive narrowband filter.

17. The system of claim 11 wherein an input sine wave frequency comprises an engine harmonic noise frequency.

18. The system of claim 11 wherein the transducer outputs are directed into the vehicle cabin.

19. The system of claim 11 wherein the transducer outputs are directed into a volume of the motor vehicle other than the vehicle cabin.

* * * * *